US009637865B2

(12) United States Patent
Rosencrance et al.

(10) Patent No.: US 9,637,865 B2
(45) Date of Patent: May 2, 2017

(54) METHOD FOR PRODUCING POLYACRYLAMIDE COMPOSITION

(71) Applicant: KEMIRA OYJ, Helsinki (FI)

(72) Inventors: Scott Rosencrance, Douglasville, GA (US); Chen Lu, Marietta, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 14/791,383

(22) Filed: Jul. 3, 2015

(65) Prior Publication Data

US 2017/0002519 A1 Jan. 5, 2017

(51) Int. Cl.

| | |
|---|---|
| ***D21H 17/55*** | (2006.01) |
| ***D21H 17/06*** | (2006.01) |
| ***D21H 21/20*** | (2006.01) |
| ***D21H 21/18*** | (2006.01) |
| ***D21H 17/38*** | (2006.01) |

(52) U.S. Cl.

CPC ..... *D21H 21/20* (2013.01); *D21H 17/38* (2013.01); *D21H 21/18* (2013.01)

(58) Field of Classification Search

None

See application file for complete search history.

(56) References Cited

U.S. PATENT DOCUMENTS

| | | | | |
|---|---|---|---|---|
| 3,556,932 | A | 1/1971 | Coscia et al. | |
| 4,605,702 | A | 8/1986 | Guerro et al. | |
| 4,954,538 | A | 9/1990 | Dauplaise et al. | |
| 8,197,640 | B2 | 6/2012 | Schaffer | |
| 8,435,382 | B2 * | 5/2013 | Lu | D21H 17/375 162/158 |
| 2006/0037727 | A1 | 2/2006 | Hagiopol et al. | |
| 2006/0270801 | A1 | 11/2006 | Hagiopol et al. | |
| 2008/0308242 | A1 | 12/2008 | Lu et al. | |
| 2009/0165978 | A1 | 7/2009 | Hagiopol et al. | |

FOREIGN PATENT DOCUMENTS

| | | | |
|---|---|---|---|
| DE | 44 14 267 | A1 | 10/1995 |
| EP | 0 133 699 | A2 | 3/1985 |
| EP | 0 678 528 | A1 | 10/1995 |
| WO | 2015/065688 | A1 | 5/2015 |

* cited by examiner

*Primary Examiner* — Vu A Nguyen

(74) *Attorney, Agent, or Firm* — Young & Thompson

(57) ABSTRACT

Disclosed is a method for producing an aldehyde crosslinked polyacrylamide composition useful for strengthening paper. The method includes steps, wherein a) an aldehyde cross-linker and polyacrylamide are mixed in water to form an aqueous solution of aldehyde crosslinked polyacrylamide prepolymer; b) acid is added to the aqueous prepolymer solution to adjust the pH of the solution to a value between 1 to 5; c) storing and transporting the prepolymer solution to the location where the final glyoxalated polyacrylamide composition will be used; and d) adding a base to the stabilized prepolymer solution to adjust the pH of the solution to value between 5.5 to 12, and e) allowing the aldehyde crosslinker and polyacrylamide contained in the aldehyde crosslinked polyacrylamide prepolymer solution to react further and form aldehyde crosslinked polyacrylamide composition useful for strengthening paper.

10 Claims, No Drawings

METHOD FOR PRODUCING POLYACRYLAMIDE COMPOSITION

FIELD OF THE INVENTION

The present invention is in the field of paper making. The present invention provides a method for making compositions for increasing paper strength in papermaking process. More particularly the present invention provides a method of making compositions possessing ability to increase temporary wet and dry strength of paper and/or paperboard.

BACKGROUND OF THE INVENTION

During papermaking process various chemicals are commonly added to enhance the physical properties of paper. Especially, there is a great variety of wet end additives designed for improving paper dry strength and/or wet strength. These additives typically have a given ionic charge to provide their molecules with sufficient affinity to be retained on cellulose fibers. Ionic polyacrylamides are well-known as such strength resins.

Ionic polyacrylamides are copolymers containing ionic monomers and acrylamide-containing monomers. The polyacrylamide backbone incorporates a small amount of an anionic or cationic monomer, e.g. diallyldimethyl ammonium chloride (DADMAC), rendering the polymer self-retaining on fibers.

These ionic polyacrylamide based additives are commonly modified to be more effective in improving the wet strength by use of crosslinking agents like glyoxal. GPAM is a reactive polymer that can covalently bind with cellulose upon dehydration. As an example, glyoxylated polyacrylamide (GPAM) is generally used in a variety of paper grades to enhance the dry and temporary wet strength. For example, GPAM increases the initial wet strength of many household tissues which come in contact with water in use. GPAM is also applied to increase the compression strength and the dimensional stability of many board-grade paper products.

Glyoxal and polyaldehyde compounds have been utilized as crosslinkers. However, glyoxal is very soluble in water and does not interact efficiently with other chemicals or compositions, particularly heterogeneous materials dispersed in small quantities in large volumes of water, e.g., such as gelatinized starch molecules or cellulosic fibers present in the wet-end of the paper making process. Thus, addition of glyoxal or other low molecular weight crosslinkers directly to the wet-end of the papermaking process has not been found to provide benefit to end product of the paper making process. Therefore ready-to-use compositions that contain the crosslinkers must be produced before addition to the wet end of a papermaking process.

The synthesis of GPAM was first reported in U.S. Pat. No. 3,556,932. The product was prepared by reacting glyoxal with a cationic polyacrylamide in slightly alkaline aqueous solution and stabilized under acidified condition.

The use of crosslinkers in such compositions is not straightforward, because problem arises regarding the stability and storage life of these compositions. Simple mixing of glyoxal with a polyacrylamide solution rapidly affords a gel. Under storage, the reaction between glyoxal and polyacrylamide continues, resulting in the increase of product viscosity over time and sometimes product gelling. Consequently, GPAM products are often produced at concentrations below 15% in order to extend shelf life.

Due to poor stability, regardless of pH, the molecular weights of current glyoxalated polyacrylamides continue to increase, even at room temperature, until the polymers gel. In most cases significant dilution to as low as 8.0% active solids concentration is needed. In addition to that, pH adjustment to 3.0-4.0 is required as well as storing at lower than room temperatures to ensure practical lengths of shelf lives. This increases costs especially during the summer or otherwise hot climate conditions, but most remarkable increase in costs becomes from the significant dilution of the composition, which affects the shipping and storing costs.

A variety of polymeric stabilizing agents have been discussed, but such agents increase the costs of the product and also increases the complexity of the composition. It is preferable that minimum amount of different chemicals would be put into the paper making process, because any additional chemical may cause problems in the complex paper making process.

U.S. Pat. No. 4,954,538 describes compositions comprising microparticles of a cross-linkable, glyoxalated (meth) acrylamide containing, polymeric material. The compositions are prepared using inverse microemulsion polymerization techniques and the products are said to be useful as wet- and dry-strength agents in paper production. It is indicated that commercial glyoxalated acrylamide polymers, supplied as 10% solid solutions, gel within about 8 days at room temperature.

U.S. Pat. No. 4,605,702 relates to the preparation of GPAM using a base polymer with a low molecular weight ranging from 500 Daltons to 6000 Daltons. The exemplified glyoxalated polyacrylamide products in U.S. Pat. No. 4,605,702 have a concentration of about 20% by weight cationic monomer, but were indicated as being used in much higher dosages to compare wet strength properties with exemplified products in US patent.

For the last decade, much research work has been carried out to reduce shipping and handling cost associated with GPAM products. U.S. Pat. No. 8,197,640 discloses a method for on-site GPAM production. Highly concentrated solutions of glyoxal and polyacrylamide are delivered to the papermaking mill separately. Afterwards at the paper mill, dilute GPAM products are prepared shortly before being applied to the paper machine.

The art continues to search for ways for producing glyoxalated polyacrylamide strengthening agents having good stability and at the same time lower the shipping costs.

DESCRIPTION OF THE INVENTION

An object of the present invention is thus to provide a method to alleviate the above problems. The present invention provides a method that can be used to alleviate the shelf-life and gelling problems that are caused by premature crosslinking of the strength improving compositions. The objects of the invention are achieved by a method which is characterized by what is stated in the independent claim. The preferred embodiments of the invention are disclosed in the dependent claims.

Accordingly the present invention provides as a first aspect a method for producing an aldehyde crosslinked polyacrylamide composition useful for strengthening paper.

The present invention is a combination of traditional off-site production of paper additives and on-site production. The typical prior art production methods for aldehyde crosslinked polyacrylamide compositions have been off-site methods, which means the crosslinked polyacrylamide compositions have not been produced at paper mill, but on the manufacturing plant of the chemical provider. The crosslinked polyacrylamide compositions have been prepared so that they are stable during shipping and storing, and therefore a significant dilution to as low as 8.0% active solids concentration has been needed.

In order to avoid the high shipping costs of a very dilute solutions of the additives, some on-site production methods has been disclosed more recently. In such methods the crosslinked polyacrylamide compositions have been produced at the paper mill from the starting materials. However, because paper mills often have limited space and personnel for on-site chemical production, a simplified on-site production approach is always favored by papermakers. The present invention provides a solution for this.

This invention provides a new on-site production method for aldehyde crosslinked polyacrylamide compositions. According to this method, aldehyde crosslinked polyacrylamide compositions are prepared in two stages. In the first stage, aldehyde crosslinker and polyacrylamide basepolymer are mixed to produce a concentrated prepolymer product with a solid content of at least 20%. The prepolymer can be a simple blend and stabilized under acidic conditions. Alternatively, aldehyde crosslinker and polyacrylamide basepolymer can react to a predetermined viscosity range under alkaline conditions before being stabilized by acid. In the second stage, the prepolymer is diluted by water and the aldehyde crosslinking reaction is reactivated by adjusting the solution to alkaline pH conditions. Once reaching a predetermined final viscosity range, the product can be applied to the paper machine directly with or without further dilution by water.

In more detail, the present invention provides a method for producing an aldehyde crosslinked polyacrylamide composition useful for strengthening paper, wherein the method comprises following steps:

a. mixing aldehyde crosslinker and polyacrylamide basepolymer in water to form an aqueous solution of aldehyde crosslinked polyacrylamide prepolymer,
b. adding acid to said aqueous prepolymer solution to adjust the pH of the solution to a value between 1 to 5, and thus forming a stabilized aldehyde crosslinked polyacrylamide prepolymer solution,
c. storing said stabilized aldehyde crosslinked polyacrylamide prepolymer solution and transporting it to the location where the final glyoxalated polyacrylamide composition will be used,
d. adding a base to the stabilized aldehyde crosslinked polyacrylamide prepolymer solution to adjust the pH of the solution to value between 5.5 to 12,
e. allowing the aldehyde crosslinker and polyacrylamide contained in the aldehyde crosslinked polyacrylamide prepolymer solution to react further and form aldehyde crosslinked polyacrylamide composition useful for strengthening paper.

In the above disclosed method steps a) and b) form the first stage of the method, and steps d) and e) form the second stage of the method. Between these two stages the prepolymer is stored and shipped (transported) to paper mill where it will be used. Storing may be conducted by using shipping containers, and thus, shipping and storing can also be understood to be a single procedure without any separate storing step.

For the purpose of the present invention "aldehyde crosslinker" refers to a compound containing one or more aldehyde (—CHO) groups, where the aldehyde groups are capable of reacting with the amino or amido groups of a polymer comprising amino or amido groups as described herein. Exemplary aldehydes can include formaldehyde, paraformaldehyde, glutaraldehyde, glyoxal, and the like. Glyoxal is preferred.

For the purpose of the present invention "polyacrylamide" refers to a copolymer containing ionic monomers and acrylamide-containing monomers. Examples of suitable acrylamide-containing monomers include acrylamide and methacrylamide. Ionic monomers can be anionic or cationic. Examples of suitable anionic monomers include acrylic acid, methacrylic acid, methacrylamide 2-acrylamido-2-methylpropane sulfonate (AMPS), styrene sulfonate, and mixtures thereof as well as their corresponding water soluble or dispersible alkali metal and ammonium salts. Examples of suitable cationic monomers are diallyldimethylammonium chloride, acryloyloxyethyltrimethyl-ammonium chloride, dimethylaminoethylmethacrylate sulfate, methatcrylamido-propyltrimethylammonium chloride, methacryloyloxyethyltrimethylammonium chloride, and mixtures thereof. Polyacrylamide basepolymers can be cationic, anionic, or amphoteric. The net charge of amphoteric basepolymers can be cationic, anionic, or neutral.

"Polyacrylamide basepolymer" refers to polyacrylamide used as a starting material in the present invention.

For the purpose of the present invention "aldehyde crosslinked polyacrylamide prepolymer solution" refers to an aqueous solution of aldehyde crosslinker and polyacrylamide basepolymer, which have been allowed to react to predetermined viscosity, which is lower than the viscosity of the final aldehyde crosslinked polyacrylamide that will be used at the paper mill. Because "aldehyde crosslinked polyacrylamide prepolymer solution" is not stable as such, it has to be stabilized. In the present invention the stabilization can be done by adjusting the pH of the solution to a value between 2 to 4, and thus forming a "stabilized aldehyde crosslinked polyacrylamide prepolymer solution".

For the purpose of the present invention "aldehyde crosslinked polyacrylamide" refers to the final reaction product, which is obtained from the further reaction of the aldehyde crosslinked polyacrylamide prepolymer solution. The prepolymer has been allowed to react to predetermined viscosity and thus forming "aldehyde crosslinked polyacrylamide", which is the additive designed for improving paper dry strength and/or wet strength. An example of an aldehyde crosslinked polyacrylamide is glyoxalated polyacrylamide (GPAM), which is one of the preferred embodiments of the invention.

The inventive concept of the present invention is based on the realization that aldehyde crosslinked polyacrylamide prepolymer solutions can be stabilized by adjusting the pH to a value between 2 to 4 without the need to significantly dilute the solids concentration. Although the stability of aldehyde crosslinked polyacrylamide compositions has been intensively studied, no one had earlier thought that such stabilized prepolymers could be used to solve the stability problem and that their use would lead to a very simplified overall process.

An advantage of the present invention is that a concentrated aqueous solution of aldehyde crosslinked polyacrylamide prepolymer can be produced and stabilized, and then shipped to the paper mill. This reduces the costs related to shipping and intermediate storing remarkably. In the method of the present invention aldehyde crosslinker and polyacrylamide basepolymer can be mixed at a solid content as high as 40% and shipped to papermaking mills without gelling before carrying out the second step reaction.

In an embodiment of the present invention the stabilized prepolymer solution has a solid content from 20% to 50%.

Preferably the solid content of the stabilized prepolymer solution is from 25 to 50% and more preferably from 30 to 40%.

It is an advantage of the present invention that the prepolymer can react to a predetermined viscosity value before being shipped to paper mills for the second stage reaction. This approach will reduce on-site reaction time and further simplify on-site production complexity. Preferably, the on-site production can be carried out in a continuous fashion with reduced reaction time.

It is another advantage of the present invention that the prepolymer can be shipped and handled as a single product. In comparison, crosslinker and polyacrylamide are shipped and handled separated in conventional on-site production approaches. This new inventive approach can eliminate the on-site mixing step and also reduces the number of storage vessels or alternatively can use these added facets to further improve the resulting product performance if appropriate.

The present invention is not limited to methods where the prepolymer is used alone as a single product in the second stage of the method. In an embodiment of the present invention it is also possible that the ratio of aldehyde crosslinker to polyacrylamide basepolymer is adjusted by adding additional aldehyde crosslinker and/or polyacrylamide basepolymer in the second stage of the inventive method. The amount of additional aldehyde crosslinker may be as high as 90% as calculated from the total amount of the aldehyde crosslinker in the composition after the addition. The amount of additional polyacrylamide basepolymer may be as high as 90% as calculated from the total amount of the polyacrylamide basepolymer in the composition after the addition. It is however preferred embodiment that further addition of aldehyde crosslinker and polyacrylamide basepolymer can be avoided in the second stage of the method.

In the second stage, during steps d) and e), the prepolymer is diluted by water and the aldehyde crosslinking reaction is reactivated by adjusting the solution to alkaline pH conditions or at least to pH values ranging from 5.5 to 12. Once reaching a predetermined final viscosity range, the product can be applied to the paper machine directly with or without further dilution by water. Preferred viscosity ranges are 10 to 100 cps for an 8% final product using a Broofield SVT viscometer.

In an embodiment of the invention, the method comprises a further step, wherein the formed aldehyde crosslinked polyacrylamide composition from step e) is further diluted by addition of water. The solid content of the composition after this additional dilution step can be from 1% to 25%, preferably from 4% to 20%, more preferably from 7% to 15%.

In another embodiment of the invention, the method comprises a further step, wherein the formed aldehyde crosslinked polyacrylamide composition from step e) is directly added as a strength enhancer to fiber slurry at a paper mill, with or without the further dilution by water.

In an embodiment of the invention, the method comprises a further step, wherein the formed aldehyde crosslinked polyacrylamide composition from step e) is stabilized by adding acid to said composition and adjusting the pH to a value between 2 to 5, and storing said stabilized composition for later use as a strength enhancer, with or without the further dilution by water.

In the present invention the pH adjustment during the stabilization can be done with a combination acid and base addition. Preferred acids include sulfuric acid, hydrochloric acid, hydrobromic acid, phosphoric acid, nitric acid, formic acid, acetic acid, propionic acid, butyric acid, valeric acid, caproic acid, oxalic acid, lactic acid, malic acid, citric acid, carbonic acid, and adipic acid. Preferred bases include sodium hydroxide, potassium hydroxide, lithium hydroxide, cesium hydroxide, barium hydroxide, ammonium, magnesium hydroxide, aluminum hydroxide, sodium silicate, sodium carbonate, sodium bicarbonate, lime, and calcium hydroxide. Combination of acid and base may be used to provide a puffer to the solution, which further stabilizes it.

EXAMPLES

Raw materials 40% glyoxal aqueous solution was obtained from BASF. The cationic polyacrylamide sample was a 40% aqueous solution of copolymer of acrylamide and diallyldimethylammonium chloride (DADMAC).

Examples 1-8

Prepolymers by Blending Glyoxal and Polyacrylamide

In these examples, glyoxal and polyacrylamide were mixed and stabilized under low pH conditions. Conventional GPAM products often build up excessive viscosity under storage. In many cases, they gelled completely and became un-usable when stored over an extended period of time, especially at elevated temperatures. The objective of this invention is to ensure that glyoxal/polyacrylamide blends remain fluid during the shipping period. Consequently, the second stage of on-site reaction can be carried out successfully.

Table 1 presents product viscosity change as a function of time at an elevated temperature of 35° C. Product solid contents were adjusted by adding additional de-ionized water. Final pH was adjusted using 10% sulfuric acid solution or 10% sodium hydroxide solution. After 8 days of aging, all samples remained fluid. The viscosity value of 40% blend increased only from 68 cps to 96 cps and the viscosity value of 25% blend remained almost unchanged at around 15-17 cps. This study shows that glyoxal and polyacrylamide can be mixed at a solid content as high as 40% and shipped to papermaking mills without gelling before carrying out the second stage reaction.

TABLE 1

Examples 1-8, stability as a function of time at 35° C.

| Ex. | PAM (g) | Glyoxal (g) | Water (g) | Solid content | pH | Viscosity (cps) Day 0 | Day 4 | Day 8 | Day 10 | Day 21 |
|---|---|---|---|---|---|---|---|---|---|---|
| 1 | 77 | 23 | 0 | 40% | 2.5 | 68 | 74 | 96 | | |
| 2 | 77 | 23 | 0 | 40% | 3.5 | 68 | 75 | 96 | | |
| 3 | 67.3 | 20.2 | 12.5 | 35% | 2.5 | 34 | 35 | NA | 46 | 61 |
| 4 | 67.3 | 20.2 | 12.5 | 35% | 3.5 | 34 | 34 | NA | 46 | 60 |
| 5 | 57.7 | 17.3 | 25 | 30% | 2.5 | 23 | 23 | NA | 25 | 29 |
| 6 | 57.7 | 17.3 | 25 | 30% | 3.5 | 22 | 22 | NA | 24 | 27 |
| 7 | 48.1 | 14.4 | 37.5 | 25% | 2.5 | 15 | 16 | NA | 16 | 17 |
| 8 | 48.1 | 14.4 | 37.5 | 25% | 3.5 | 15 | 16 | NA | 16 | 17 |

Examples 9-12

Prepolymers by Reacting Glyoxal and Polyacrylamide to a Pre-Determined Viscosity Value In these examples, glyoxal and polyacrylamide were mixed and pH was increased to 9.0 using the dilute NaOH solution. The weight ratio of glyoxal to polyacrylamide was adjusted at 0.23. The solid content was 23%. Once the solution viscosity increased to a pre-determined value, dilute sulfuric acid was added to quench the reaction and stabilize the product. As shown in Table 2, all samples were stable for more than one week at 35° C. Additionally, the shelf life of prepolymer was also a function of final viscosity and final pH. Low viscosity and lower pH led to longer shelf life.

TABLE 2

Examples 9-12 stability as a function of time at 35° C.

| Ex. | Solid content | Final pH | Initial viscosity (cps) | Final viscosity (cps) | Days to gel |
|---|---|---|---|---|---|
| 9 | 23% | 2.5 | 10.3 | 15.6 | 29 |
| 10 | 23% | 2.5 | 10.3 | 20.4 | 22 |
| 11 | 23% | 2.5 | 10.3 | 28.1 | 14 |
| 12 | 23% | 3.5 | 10.3 | 15.7 | 9 |

Examples 13-14

GPAM

Examples 13 and 14 were GPAM products with the same composition and properties. However, Example 13 was prepared by the conventional one-step reaction, whereas Example 14 was prepared by the two-step reaction. The objective of this study was to investigate whether the two-step approach would affect product strength performance or not.

For Example 13, glyoxal, polyacrylamide, and water were first added to a glass vessel and mixed using a magnetic stirring bar. The weight ratio of glyoxal to polyacrylamide was set at 0.3 and the solid content was set at 11.5%. pH was then adjusted to 9.0 to initiate the reaction. Once the viscosity value reached 21 cps, dilute acid was used to stabilize the product. For Example 14, glyoxal, Example 11 (prepolymer), and water were added to a glass vessel and reaction was initiated by adjusting solution pH to 9.0. Once the viscosity value reached 21 cps, dilute acid was stabilize the product.

Table 3 compares wet tensile strength performance between Example 13 and Example 14. In summary, these two products provided similar initial wet tensile and also permanent wet tensile. This result indicates that the two-approach reaction has no significant impact on GPAM strength properties.

TABLE 3

Wet tensile strength

| | Initial wet tensile (lb/in) | Permanent wet tensile (lb/in) |
|---|---|---|
| Blank | 0.65 | 0.18 |
| Example 13 | 1.62 | 0.73 |
| Example 14 | 1.56 | 0.71 |

The invention claimed is:

1. A method for producing an aldehyde crosslinked polyacrylamide composition useful for strengthening paper, wherein the method comprises the following steps:

a. mixing aldehyde crosslinker and polyacrylamide in water to form an aqueous solution of aldehyde crosslinked polyacrylamide prepolymer, b. adding acid to said aqueous prepolymer solution to adjust the pH of the solution to a value between 1 to 5, and thus forming a stabilized aldehyde crosslinked polyacrylamide prepolymer solution, c. storing said stabilized aldehyde crosslinked polyacrylamide prepolymer solution and transporting it to the location where the final aldehyde crosslinked polyacrylamide composition will be used, d. adding a base to the stabilized prepolymer solution to adjust the pH of the solution to value between 5.5 to 12, e. allowing the aldehyde crosslinker and polyacrylamide contained in the aldehyde crosslinked polyacrylamide prepolymer solution to react further and form aldehyde crosslinked polyacrylamide composition useful for strengthening paper.

2. The method according to claim 1, wherein the aldehyde crosslinker is formaldehyde, paraformaldehyde, glutaraldehyde or glyoxal.

3. The method according to claim 1, wherein the formed aldehyde crosslinked polyacrylamide composition is further diluted by the addition of water.

4. The method according to claim 1, wherein the formed aldehyde crosslinked polyacrylamide composition is directly added as a strength enhancer to fiber slurry at a paper mill, with or without a further dilution by water.

5. The method according to claim 1, wherein the formed aldehyde crosslinked polyacrylamide composition is stabilized by adding acid to said composition and adjusting the pH to value between 1 to 5, and storing said stabilized composition for later use as a strength enhancer, with or without a further dilution by water.

6. The method according to claim 1, wherein the pH adjustment during the stabilization is done with a combination of acid and base addition.

7. The method according to claim 1, wherein the stabilized aldehyde crosslinked polyacrylamide prepolymer solution has a solid content from 20% to 50%.

8. The method according to claim 1, wherein the stabilized aldehyde crosslinked polyacrylamide prepolymer solution has a viscosity from 5 to 15000 cps.

9. The method according to claim 1, wherein the steps d) or e) further comprises an addition of additional glyoxal and/or polyacrylamide to the solution.

10. The method according to claim 1, wherein a glyoxalated polyacrylamide composition useful for strengthening paper is prepared, and wherein the method comprises the following steps:

a. mixing aqueous solutions of glyoxal and polyacrylamide to form an aqueous solution of glyoxalated polyacrylamide (GPAM) prepolymer, b. adding acid to said aqueous prepolymer solution to adjust the pH of the solution to value between 1 to 5, and forming a stabilized GPAM prepolymer solution, c. storing said stabilized GPAM prepolymer solution and transporting it to a location where the final glyoxalated polyacrylamide composition will be used, d. adding a base to the stabilized GPAM prepolymer solution to adjust the pH of the solution to value between 5.5 to 12, e. allowing the glyoxal and polyacrylamide contained in the GPAM prepolymer solution to react further and form glyoxalated polyacrylamide composition useful for strengthening paper.

* * * * *